US008651640B2

(12) United States Patent
Hsueh et al.

(10) Patent No.: US 8,651,640 B2
(45) Date of Patent: Feb. 18, 2014

(54) INK SUPPLY STRUCTURE AND FABRICATING METHOD THEREOF

(71) Applicant: Microjet Technology Co., Ltd, Hsinchu (TW)

(72) Inventors: Ta-Wei Hsueh, Hsinchu (TW); Ying-Lun Chang, Hsinchu (TW); Yung-Lung Han, Hsinchu (TW); Chi-Feng Huang, Hsinchu (TW); Chun-Cheng Ho, Hsinchu (TW)

(73) Assignee: Microjet Technology Co., Ltd., Hsinchu (TW)

( * ) Notice: Subject to any disclaimer, the term of this patent is extended or adjusted under 35 U.S.C. 154(b) by 1424 days.

(21) Appl. No.: 13/668,627

(22) Filed: Nov. 5, 2012

(65) Prior Publication Data

US 2013/0113865 A1 May 9, 2013

(30) Foreign Application Priority Data

Nov. 7, 2011 (TW) ..... 100140579 A

(51) Int. Cl.
*B41J 2/175* (2006.01)

(52) U.S. Cl.
USPC ..... 347/86; 347/87

(58) Field of Classification Search
USPC ..... 347/30, 85–87, 96, 98, 100; 890/0.1
See application file for complete search history.

(56) References Cited

U.S. PATENT DOCUMENTS

| | | | | |
|---|---|---|---|---|
| 6,336,705 | B1 * | 1/2002 | Torigoe | 347/43 |
| 6,659,601 | B2 * | 12/2003 | Goto et al. | 347/100 |
| 7,537,298 | B2 * | 5/2009 | Oshio et al. | 347/9 |
| 7,604,310 | B2 * | 10/2009 | Sugimoto | 347/7 |
| 7,637,577 | B2 * | 12/2009 | Kawakami | 347/5 |
| 7,648,218 | B2 * | 1/2010 | Iwata | 347/19 |

* cited by examiner

*Primary Examiner* — Anh T. N. Vo
(74) *Attorney, Agent, or Firm* — Evan R. Witt; Kirton McConkie

(57) ABSTRACT

An ink supply structure includes at least one ink cartridge, at least one dye ink chamber, and at least one pigment ink chamber. The at least one dye ink chamber is contained in the at least one ink cartridge for storing a dye ink. The at least one pigment ink chamber is contained in the at least one ink cartridge for storing a pigment ink. One of the dye ink within the dye ink chamber and the pigment ink within the pigment ink chamber is selectively supplied from the at least one ink cartridge.

4 Claims, 7 Drawing Sheets

INK SUPPLY STRUCTURE AND FABRICATING METHOD THEREOF

FIELD OF THE INVENTION

The present invention relates to an ink supply structure, and more particularly to an ink supply structure for selectively supplying a dye ink or a pigment ink. The present invention also relates to a method of fabricating the ink supply structure.

BACKGROUND OF THE INVENTION

Generally, the ink used in a color inkjet printer is classified into two types, i.e. a dye ink and a pigment dye. The dye ink or the pigment dye is a colored material that selectively absorbs visible light. Moreover, the dye ink or the pigment dye is a colored material with a specified color. Generally, the dye ink has the affinity to fibers and other materials, the ability of selectively absorbing the light through water or other media, and the dyeing capacity. Whereas, the pigment ink has no dyeing capacity for fibers and other materials, and is insoluble in water. In other words, the pigment ink is insoluble in the ink solvent and has a waterproof property, but the dye ink is soluble in the ink solvent.

For most inkjet printers, the water-based pigment ink is the most popular. As known, the water-based pigment ink is waterproof and has a high anti-light coefficient. Moreover, the use of the water-based pigment ink may generate low environmental pollution and can be printed on the ordinary paper with desired output quality. However, the manufacture of the pigment ink needs a high technical threshold, and the pigment ink is costly and has large particles.

Moreover, the current color inkjet printer usually employs four kinds of inks (e.g. a magenta ink, a yellow ink, a cyan ink and a black ink) to perform the inkjet printing task. Generally, in views of the printed color levels, the four color pigment inks are inferior to the four color dye inks. In a case that a color inkjet printer with more than seven monochromatic inks is employed to perform the inkjet printing task, the printed color levels of the pigment inks are possibly better than the dye inks.

From the above discussions, the dye ink and the pigment ink have their advantages and disadvantages. In addition, the print media and the printing quality for the dye ink and the pigment ink are distinguished. In the current color inkjet printer, the ink filled in the ink cartridge is either a dye ink or a pigment ink. In addition, the ink type fails to be freely and simply changed by the user according to the printing requirements. For example, if the user wants to print an image on a bright and vivid article, it is preferred to use the ink cartridge containing the dye ink. Once the user wants to print an image on the waterproof article, the ink cartridge containing the dye ink is no longer feasible. Meanwhile, the ink cartridge containing the dye ink should be replaced by an ink cartridge containing the pigment ink. Before the ink cartridge containing the pigment ink is installed, it is necessary to realize whether the ink cartridge containing the pigment ink is supported by the color inkjet printer or not. If the ink cartridge containing the pigment ink fails to be supported by the color inkjet printer, the ink cartridge or the color inkjet printer should be changed, so that the operating cost is increased. In other words, the use of the ink cartridge containing a single dye ink or a single pigment ink becomes hindrance from operating the color inkjet printer.

Therefore, there is a need of providing an improved ink supply structure for allowing the user to select one of the dye ink and the pigment ink to perform an inkjet printing task.

SUMMARY OF THE INVENTION

The present invention provides an ink supply structure to overcome the problems that the use of the conventional ink cartridge containing a single dye ink or a single pigment ink is hindrance from operating the color inkjet printer and the ink type fails to be freely and simply changed by the user according to the printing requirements.

The present invention provides an ink supply structure for allowing the user to select one of the dye ink and the pigment ink to perform an inkjet printing task.

In accordance with an aspect of the present invention, there is provided an ink supply structure. The ink supply structure includes at least one ink cartridge, at least one dye ink chamber, and at least one pigment ink chamber. The at least one dye ink chamber is contained in the at least one ink cartridge for storing a dye ink. The at least one pigment ink chamber is contained in the at least one ink cartridge for storing a pigment ink. One of the dye ink within the dye ink chamber and the pigment ink within the pigment ink chamber is selectively supplied from the at least one ink cartridge.

In accordance with a further aspect of the present invention, there is provided an ink supply structure. The ink supply structure includes: at least one ink cartridge, each of which comprises at least one dye ink chamber for storing a dye ink and at least one pigment ink chamber for storing a pigment ink so that one of the dye ink within the dye ink chamber and the pigment ink within the pigment ink chamber is selectively supplied from the at least one ink cartridge; a print head structure having plural inkjet chips corresponding to the at least one dye ink chamber and the at least one pigment ink chamber, respectively, wherein the dye ink within the at least one dye ink chamber and the pigment ink within the at least one pigment ink chamber are selected to be ejected through the inkjet chips; and at least one opening, wherein the dye ink from at least one dye ink chamber or the pigment ink from the at least one pigment ink chamber is transferred to the print head structure through the opening.

In accordance with a further aspect of the present invention, there is provided a method of fabricating an ink supply structure. The method includes the following steps. Firstly, at least one ink cartridge is provided. Then, at least one dye ink chamber and at least one pigment ink chamber are formed in the at least one ink cartridge. Afterwards, a dye ink and a pigment ink are filled into the at least one dye ink chamber and the at least one pigment ink chamber, respectively. Consequently, the dye ink and the pigment ink are both contained in the ink cartridge and one of the dye ink within the dye ink chamber and the pigment ink within the pigment ink chamber is selectively supplied from the at least one ink cartridge.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
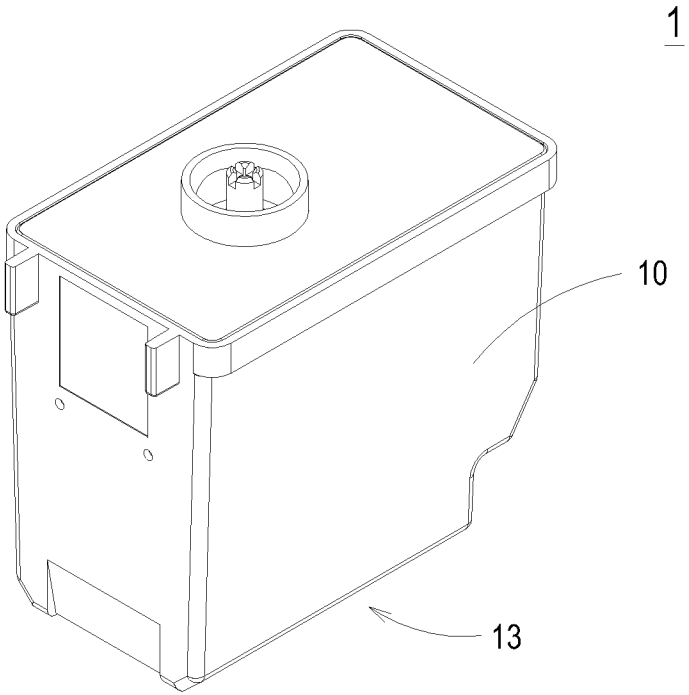
FIG. 1 is a schematic perspective view illustrating an ink supply structure according to a first embodiment of the present invention.

FIG. 1 is a schematic perspective view illustrating an ink supply structure according to a first embodiment of the present invention. The ink supply structure 1 is applied to an inkjet printing system (not shown). As shown in FIG. 1, the ink supply structure 1 at least comprises an ink cartridge 10 and a print head structure 13 corresponding to the ink cartridge 10. In this embodiment, the print head structure 13 is located at a bottom of the ink cartridge 10. Moreover, the ink cartridge 10 contains at least one dye ink chamber 11 and at least one pigment ink chamber 12 (see FIG. 2) for storing a dye ink and a pigment ink. During an inkjet printing task of the inkjet printing system is performed, one of the dye ink and the pigment ink is selectively supplied from the ink cartridge 10.

In some embodiments, the ink cartridge 10 further comprises an opening (not shown). Through the opening, the dye ink from the dye ink chamber 11 or the pigment ink from the pigment ink chamber 12 may be transferred to the print head structure 13. Moreover, the print head structure 13 further comprises at least one inkjet chip 131 corresponding to the dye ink chamber 11 and the pigment ink chamber 12 (see FIG. 2). Through the inkjet chip 131, one of the dye ink within the dye ink chamber 11 and the pigment ink within the pigment ink chamber 12 is selected to be ejected.

Figure 2:
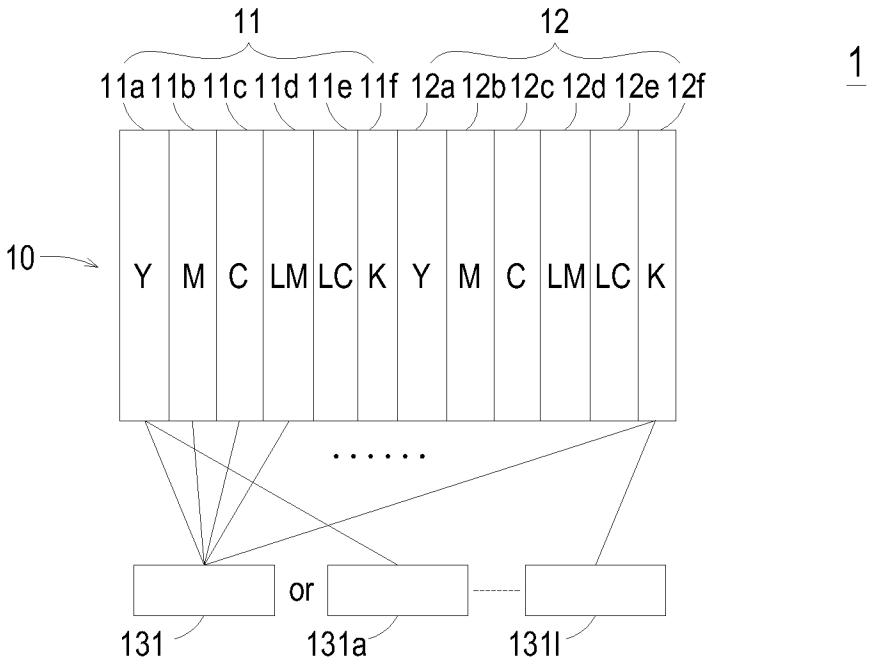
FIG. 2 schematically illustrates the relationship between the ink cartridge and the inkjet chip of the ink supply structure according to the first embodiment of the present invention.

FIG. 2 schematically illustrates the relationship between the ink cartridge and the inkjet chip of the ink supply structure according to the first embodiment of the present invention. As shown in FIG. 2, the ink supply structure 1 comprises one ink cartridge 10, and the ink cartridge 10 contains plural dye ink chambers 11 and plural pigment ink chambers 12. For example, the plural dye ink chambers 11 comprises six dye ink chambers 11*a*, 11*b*, 11*c*, 11*d*, 11*e* and 11*f* for storing six dye inks, and the plural pigment ink chambers 12 comprises six pigment ink chambers 12*a*, 12*b*, 12*c*, 12*d*, 12*e* and 12*f* for storing six pigment inks. As shown in FIG. 2, a magenta dye ink (M), a yellow dye ink (Y), a cyan dye ink (C), a light magenta dye ink (LM), a light cyan dye ink (LC) and a black dye ink (K) are stored within the six dye ink chambers 11*a*, 11*b*, 11*c*, 11*d*, 11*e* and 11*f*, respectively. In addition, a magenta pigment ink (M), a yellow pigment ink (Y), a cyan pigment ink (C), a light magenta pigment ink (LM), a light cyan pigment ink (LC) and a black pigment ink (K) are stored within the six pigment ink chambers 12*a*, 12*b*, 12*c*, 12*d*, 12*e* and 12*f*, respectively. The number of the dye ink chambers 11, the number of the pigment ink chambers 12, the ways of installing the dye ink chambers 11 and the pigment ink chambers 12 and the layout sequence of the inks may be varied according to the practical requirements.

Please refer to FIGS. 1 and 2 again. In an embodiment, the print head structure 13 comprises a single inkjet chip 131. By the inkjet chip 131, the color dye ink, the black dye ink, the color pigment ink or the black pigment ink may be supplied from the ink supply structure 1. Under this circumstance, the six dye ink chambers 11*a*, 11*b*, 11*c*, 11*d*, 11*e* and 11*f* and the six pigment ink chambers 12*a*, 12*b*, 12*c*, 12*d*, 12*e* and 12*f* in the ink cartridge 10 may be selected to eject the ink through the inkjet chip 131 collaboratively. Moreover, during the inkjet printing task of the inkjet chip 131 is performed under control of the inkjet printing system, one of the color dye ink, the black dye ink, the color pigment ink and the black pigment ink is selected to be ejected. In other words, during the inkjet printing task of the inkjet chip 131 is performed, only a selected dye ink or a selected pigment ink is ejected. Moreover, the ink supply structure 1 may further comprise an ink-pumping device (not shown). The ink-pumping device is located at a bottom of the inkjet chip 131 for removing the residual dye ink or pigment ink that is retained on the inkjet chip 131. Consequently, after the inkjet printing task is completed at each time, the residual dye ink or the residual pigment ink is removed by the ink-pumping device, and then a next inkjet printing task may be performed to eject another selected dye ink or pigment ink. In other words, when an inkjet printing task is performed to eject the selected dye ink or pigment ink, it is not necessary to worry about the residual ink and the adverse influence of the residual ink.

In some other embodiments, the print head structure 13 comprises plural inkjet chips 131*a*-131*l* corresponding to the dye ink chambers 11*a*, 11*b*, 11*c*, 11*d*, 11*e* and 11*f* and the pigment ink chambers 12*a*, 12*b*, 12*c*, 12*d*, 12*e* and 12*f* (see FIGS. 1 and 2). That is, these inkjet chips 131*a*~131*l* are used to eject the dye inks stored in the ink chambers 11*a*, 11*b*, 11*c*, 11*d*, 11*e* and 11*f* and the pigment inks stored in the pigment ink chambers 12*a*, 12*b*, 12*c*, 12*d*, 12*e* and 12*f*. Consequently, one of the color dye ink, the black dye ink, the color pigment ink and the black pigment ink may be selected to be ejected through a corresponding one of the inkjet chips 131*a*~131*l*. Since the ink within each of the dye ink chambers and the pigment ink chambers is ejected through a corresponding one of the inkjet chips 131*a*~131*l*, no residual ink is retained on the inkjet chips 131*a*~131*l*. Under this circumstance, different dye inks and different pigment inks are not mixed with each other. It is noted that the number of the inkjet chips may be varied according to the practical requirements.

Figure 3:
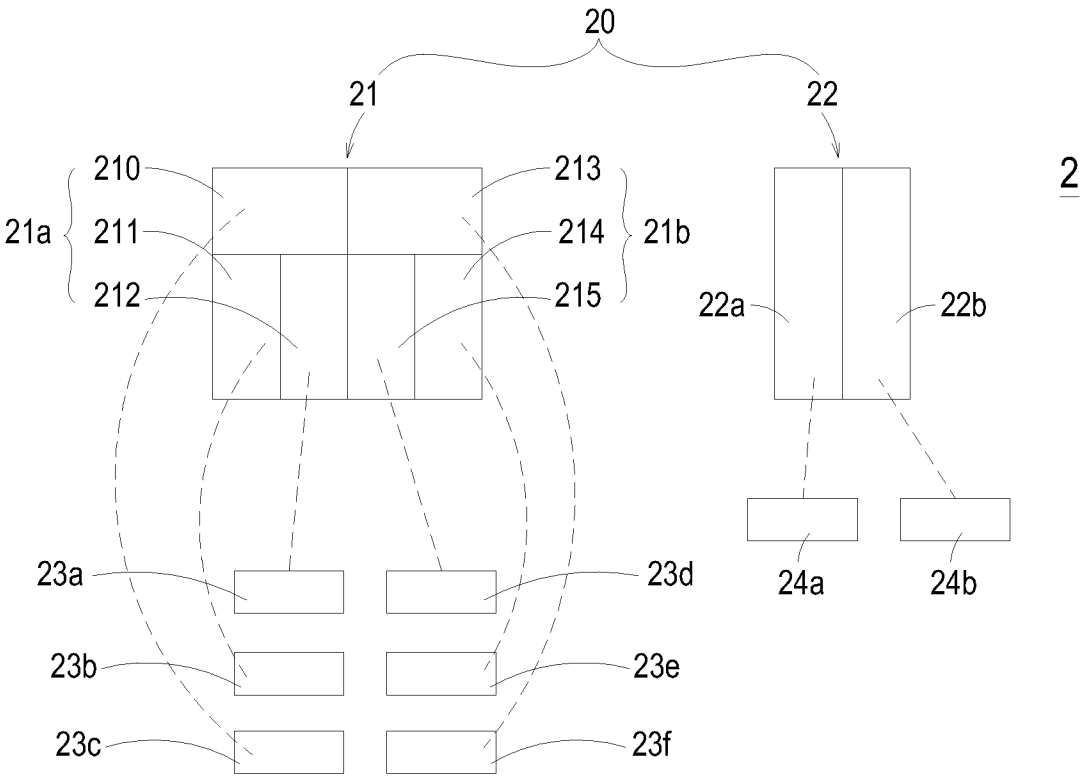
FIG. 3 schematically illustrates an ink supply structure according to a second embodiment of the present invention.

FIG. 3 schematically illustrates an ink supply structure according to a second embodiment of the present invention. As shown in FIG. 3, the ink supply structure 2 comprises plural ink cartridges 20. For example, the plural ink cartridges 20 comprise a multi-color ink cartridge 21 and a single-color ink cartridge 22. The multi-color ink cartridge 21 comprises a dye ink storing zone 21*a* and a pigment ink storing zone 21*b*. The dye ink storing zone 21*a* contains three dye ink chambers 210, 211 and 212 for storing three monochromatic dye inks and three pigment ink chambers 213, 214 and 215 for storing three monochromatic pigment inks. Consequently, the multi-color ink cartridge 21 can provide various dye inks and various pigment inks. In this embodiment, the three monochromatic dye inks include a magenta dye ink, a yellow dye ink and a cyan dye ink, and the three monochromatic pigment inks include a magenta pigment ink, a yellow pigment ink and a cyan pigment ink. It is noted that the colors of the monochromatic dye inks and the monochromatic pigment inks may be varied according to the practical requirements.

Moreover, the single-color ink cartridge 22 contains a dye ink chamber 22*a* for storing a monochromatic dye ink and a pigment ink chamber 22*b* for storing a monochromatic pigment ink. In an embodiment, the monochromatic dye ink is a black dye ink, and the monochromatic pigment ink is a black pigment ink.

Please refer to FIG. 3 again. The print head structures further comprise plural inkjet chips 23*a*, 23*b*, 23*c*, 23*d*, 23*e*, 23*f*, 24*a* and 24*b* corresponding to the plural ink cartridges 20. The inkjet chips 23*a*, 23*b*, 23*c*, 23*d*, 23*e*, 23*f* are corresponding to the multi-color ink cartridge 21, and the inkjet chips 24*a*, 24*b* are corresponding to the single-color ink cartridge 22. The dye ink chambers 210, 211, 212 of the multi-color ink cartridge 21 are corresponding to the inkjet chips 23*a*, 23*b*, 23*c*, and the pigment ink chambers 213, 214, 215 of the multi-color ink cartridge 21 are corresponding to the inkjet chips 23*d*, 23*e*, 23*f*, respectively. Similarly, the dye ink chamber 22*a* of the single-color ink cartridge 22 is corresponding to the inkjet chip 24*a*, and the pigment ink chamber 22*b* of the single-color ink cartridge 22 is corresponding to the inkjet chip 24*b*, respectively. That is, the inkjet chips 23*a*, 23*b*, 23*c*, 23*d*, 23*e*, 23*f*, 24*a* and 24*b* are separated from each other. When the inkjet printing system with the ink supply structure 2 is employed to perform the inkjet printing task, one of the dye inks and the pigment inks can be selected to be ejected through a corresponding inkjet chip. Consequently, the problem of smudging the dye ink and the pigment ink will be eliminated.

Figure 4:
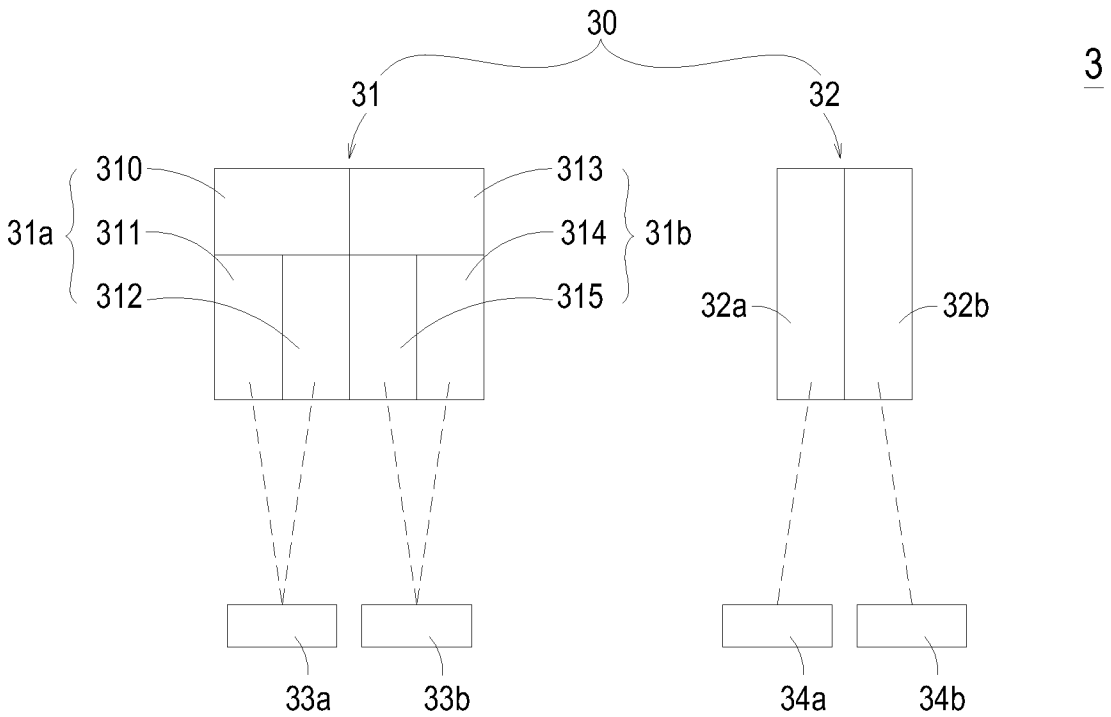
FIG. 4 schematically illustrates an ink supply structure according to a third embodiment of the present invention.

FIG. 4 schematically illustrates an ink supply structure according to a third embodiment of the present invention. As shown in FIG. 4, the ink supply structure 3 comprises plural ink cartridges 30. For example, the plural ink cartridges 30 comprise a multi-color ink cartridge 31 and a single-color ink cartridge 32. The multi-color ink cartridge 31 comprises a dye ink storing zone 31*a* and a pigment ink storing zone 31*b*. The dye ink storing zone 31*a* contains three dye ink chambers 310, 311 and 312 for storing three monochromatic dye inks and three pigment ink chambers 313, 314 and 315 for storing three monochromatic pigment inks. Consequently, the multi-color ink cartridge 31 can provide various dye inks and various pigment inks. In this embodiment, the three monochromatic dye inks include a magenta dye ink, a yellow dye ink and a cyan dye ink, and the three monochromatic pigment inks include a magenta pigment ink, a yellow pigment ink and a cyan pigment ink. It is noted that the colors of the monochromatic dye inks and the monochromatic pigment inks may be varied according to the practical requirements.

Moreover, the single-color ink cartridge 32 contains a dye ink chamber 32*a* for storing a monochromatic dye ink and a pigment ink chamber 32*b* for storing a monochromatic pigment ink. In an embodiment, the monochromatic dye ink is a black dye ink, and the monochromatic pigment ink is a black pigment ink. The arrangements and inkjet printing methods of the dye ink chamber 32*a* and the pigment ink chamber 32*b* of the single-color ink cartridge 32 and the inkjet chips 34*a* and 34*b* corresponding to the dye ink chamber 32*a* and the pigment ink chamber 32*b* are similar to those of the second embodiment, and are not redundantly described herein.

Please refer to FIG. 4 again. The print head structures further comprise plural inkjet chips 33*a*, 33*b*, 34*a* and 34*b* corresponding to the dye ink storing zone 31*a*, the pigment ink storing zone 31*b*, the dye ink chamber 32*a* and the pigment ink chamber 32*b*, respectively. In other words, during the inkjet printing task is performed, one of the dye inks within the three dye ink chambers 310, 311 and 312 may be selected to be ejected through the inkjet chip 33*a*, and one of the pigment inks within the three pigment ink chambers 313, 314 and 315 may be selected to be ejected through the inkjet chip 33*b*. Although the multi-color dye inks and the multi-color pigment inks can be ejected through the inkjet chip 33*a* and the inkjet chip 33*b* respectively when the inkjet printing task is performed, the inkjet chips 33*a* and 33*b* are separated from each other. Therefore, when the inkjet printing system with the ink supply structure 3 is employed to perform the inkjet printing task, one of the dye inks and the pigment inks can be selected to be ejected through a corresponding inkjet chip. Consequently, the problem of smudging the dye ink and the pigment ink will be eliminated.

Figure 5:
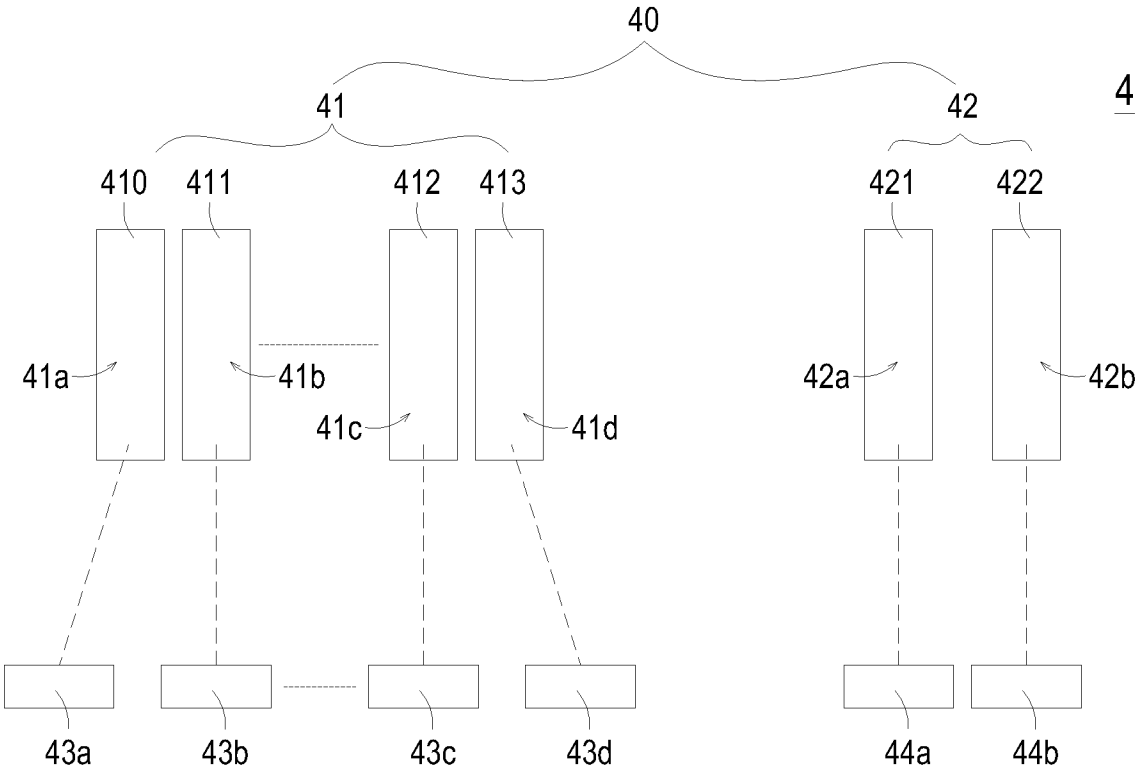
FIG. 5 schematically illustrates an ink supply structure according to a fourth embodiment of the present invention.

FIG. 5 schematically illustrates an ink supply structure according to a fourth embodiment of the present invention. As shown in FIG. 5, the ink supply structure 4 comprises plural ink cartridges 40. In this embodiment, the plural ink cartridges 40 comprise plural color ink cartridges 41 and two black ink cartridges 42. For example, the plural color ink cartridges 41 comprises a first color ink cartridge 410, a second color ink cartridge 411, a third color ink cartridge 412, and a fourth color ink cartridge 413. The first color ink cartridge 410 and the second color ink cartridge 411 contain two dye ink chambers 41*a* and 41*b* for respectively storing two monochromatic dye inks. The third color ink cartridge 412 and the fourth color ink cartridge 413 contain two pigment ink chambers 41*c* and 41*d* for respectively storing two monochromatic pigment inks. The two monochromatic dye inks are selected from two of a magenta dye ink, a yellow dye ink and a cyan dye ink. The two monochromatic pigment inks are selected from two of a magenta pigment ink, a yellow pigment ink and a cyan pigment ink. It is noted that the number of the plural color ink cartridges 41 and the colors of the inks stored in respective color ink cartridges 41 may be varied according to the practical requirements. For example, in some other embodiments, the plural color ink cartridges 41 comprise six or twelve color ink cartridges. Moreover, the colors of the monochromatic dye inks and the monochromatic pigment inks may be varied according to the practical requirements.

Moreover, the two black ink cartridges 42 comprises a first black ink cartridge 421 and a second black ink cartridge 422. The first black ink cartridge 421 and the second black ink cartridge 422 contain a dye ink chamber 42*a* and a pigment ink chamber 42*b* for storing a black dye ink and a black pigment ink, respectively.

Please refer to FIG. 5 again. The print head structures further comprise plural inkjet chips 43*a*, 43*b*, 43*c*, 43*d*, 44*a* and 44*b*. The inkjet chips 43*a* and 43*b* are corresponding to the dye ink chamber 41*a* of the first color ink cartridge 410 and the dye ink chamber 41*b* of the second color ink cartridge 411, respectively. The inkjet chips 43*c* and 43*d* are corresponding to the dye ink chamber 41*c* of the third color ink cartridge 412 and the dye ink chamber 41*d* of the fourth color ink cartridge 413, respectively. The inkjet chips 44*a* and 44*b* are corresponding to the pigment ink chamber 42*a* of the first black ink cartridge 421 and the pigment ink chamber 42*b* of and a second black ink cartridge 422, respectively. Similarly, the inkjet chips 43*a*, 43*b*, 43*c*, 43*d*, 44*a* and 44*b* are separated from each other, and each of the dye inks and the pigment inks is corresponding to a single inkjet chip. When the inkjet printing system with the ink supply structure 4 is employed to perform the inkjet printing task, one of the dye inks and the pigment inks can be selected to be ejected through a corresponding inkjet chip. Consequently, the problem of smudging the dye ink and the pigment ink will be eliminated.

Figure 6:
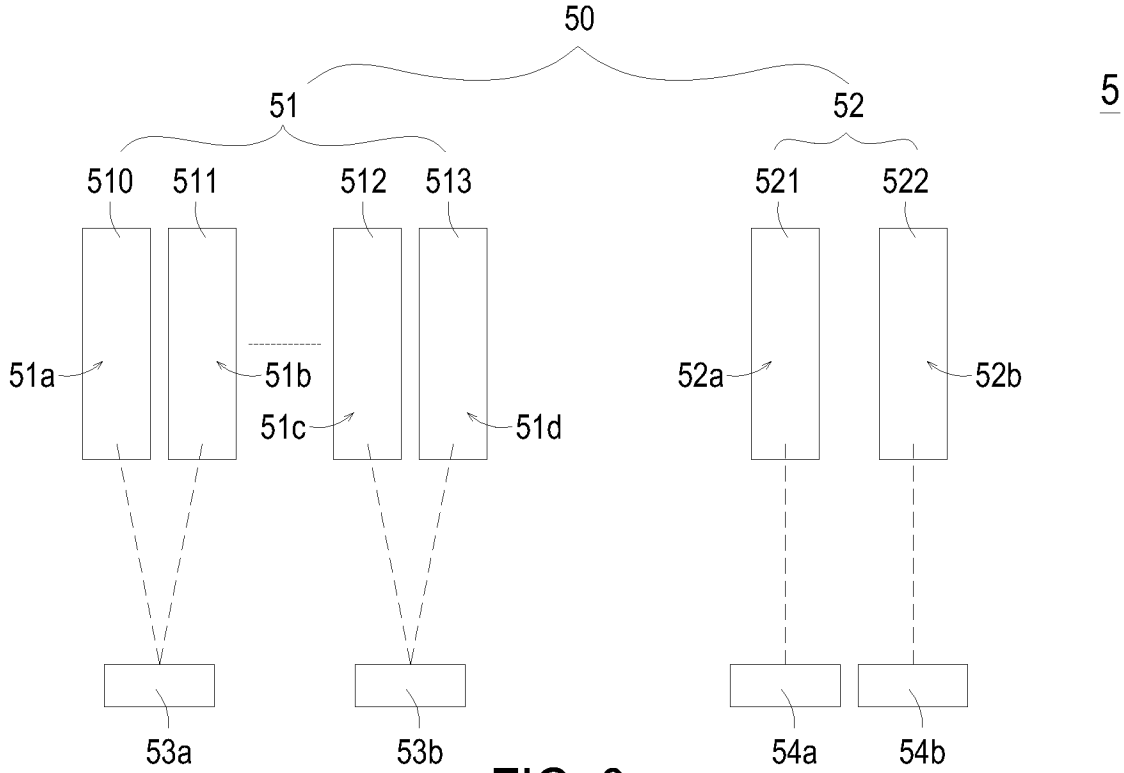
FIG. 6 schematically illustrates an ink supply structure according to a fifth embodiment of the present invention.

FIG. 6 schematically illustrates an ink supply structure according to a fifth embodiment of the present invention. As shown in FIG. 6, the ink supply structure 5 comprises plural ink cartridges 50. In this embodiment, the plural ink cartridges 50 comprise plural color ink cartridges 51 and two black ink cartridges 52. For example, the plural color ink cartridges 51 comprises a first color ink cartridge 510, a second color ink cartridge 511, a third color ink cartridge 512, and a fourth color ink cartridge 513. The first color ink cartridge 510 and the second color ink cartridge 511 contain two dye ink chambers 51*a* and 51*b* for respectively storing two monochromatic dye inks. The third color ink cartridge 512 and the fourth color ink cartridge 513 contain two pigment ink chambers 51*c* and 51*d* for respectively storing two monochromatic pigment inks.

Moreover, the two black ink cartridges 52 comprises a first black ink cartridge 521 and a second black ink cartridge 522. The first black ink cartridge 521 and the second black ink cartridge 522 contain a dye ink chamber 52*a* and a pigment ink chamber 52*b* for storing a black dye ink and a black pigment ink, respectively.

Please refer to FIG. 6 again. The print head structure further comprises an inkjet chip 53*a* corresponding to the first color ink cartridge 510 and the second color ink cartridge 511, so that the dye inks stored in the dye ink chambers 51*a* and 51*b* may be ejected through the inkjet chip 53*a*. Namely, the multi-color dye inks stored in the first color ink cartridge 510 and the second color ink cartridge 511 can be ejected through the inkjet chip 53*a* when the inkjet printing task is performed. The print head structure further comprises an inkjet chip 53*b* corresponding to the third color ink cartridge 512 and the fourth color ink cartridge 513, so that the pigment inks stored in the pigment ink chambers 51*c* and 51*d* may be ejected through the inkjet chip 53*b*. Namely, the multi-color dye inks stored in the third color ink cartridge 512 and the fourth color ink cartridge 513 can be ejected through the inkjet chip 53*b* when the inkjet printing task is performed. The print head structure further comprises two inkjet chip 54*a* and 54*b* corresponding to the two black ink cartridges 521 and 522. The black dye ink and the black pigment ink stored in the two black ink cartridges 521 and 522 may be ejected through the inkjet chip 54*a* and 54*b*, respectively. Although the monochromatic dye inks, the multi-color dye inks, the monochromatic pigment inks or the multi-color pigment inks can be ejected through the corresponding inkjet chips 53*a*, 53*b*, 54*a* and 54*b* when the inkjet printing task is performed, the inkjet chips 53*a*, 53*b*, 54*a* and 54*b* are separated from each other. Therefore, when the inkjet printing system with the ink supply structure 5 is employed to perform the inkjet printing task, one of the dye inks and the pigment inks can be selected to be ejected through a corresponding inkjet chip. Consequently, the problem of smudging the dye ink and the pigment ink will be eliminated.

Moreover, since the plural color ink cartridges 51 and the two black ink cartridges 52 are separated from each other, a color inkjet printing task or a black inkjet printing task may be selectively performed by the user. Under this circumstance, the use of the ink supply structure 5 is more convenient, and cost of using the dye ink or the pigment ink is reduced.

Figure 7:
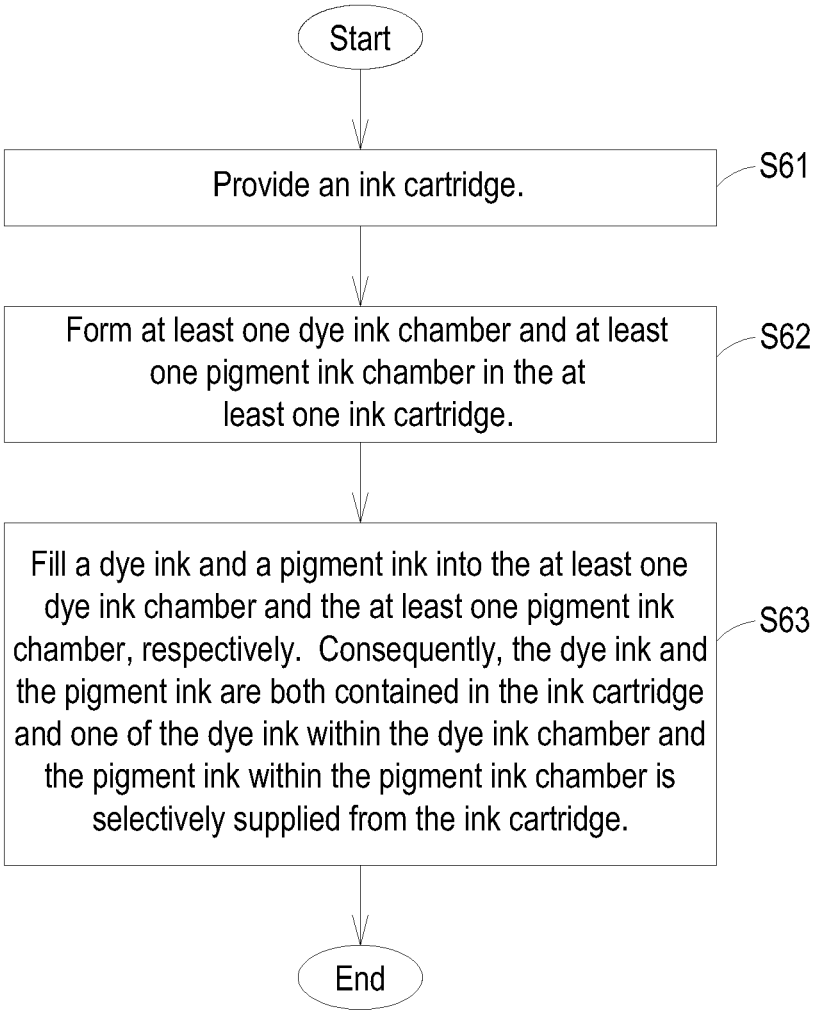
FIG. 7 schematically illustrates a flowchart of a method of fabricating an ink supply structure according to an embodiment of the present invention.

FIG. 7 schematically illustrates a flowchart of a method of fabricating an ink supply structure according to an embodiment of the present invention. The method of fabricating the ink supply structure of the first embodiment is presented herein for purpose of illustration and description only. Please refer to FIGS. 2 and 7. For fabricating the ink supply structure, an ink cartridge 10 is firstly provided (Step S61). Then, at least one dye ink chamber 11 and at least one pigment ink chamber 12 are formed in the ink cartridge 10 (Step S62). Afterwards, a dye ink and a pigment ink are filled into the at least one dye ink chamber 11 and the at least one pigment ink chamber 12, respectively (Step S63). Consequently, the dye ink and the pigment ink are both contained in the ink cartridge 10, and one of the dye ink within the dye ink chamber 11 and the pigment ink within the pigment ink chamber 12 is selectively supplied from the ink cartridge through a corresponding inkjet chip 131.

From the above description, the present invention provides an ink supply structure. The ink supply structure comprises an ink cartridge with a dye ink chamber and a pigment ink chamber. Consequently, the dye ink within the dye ink chamber or the pigment ink within the pigment ink chamber may be selected to be ejected according to the user's requirements or the printing requirements. Under this circumstance, the use of the inkjet printing system is more convenient. Furthermore, according to the practical requirements, the color inkjet printing task or the monochromatic inkjet printing task may be selectively performed to result is various printing options. Consequently, the problem of using the ink cartridge containing a single dye ink or a single pigment ink will be eliminated. Moreover, since it is not necessary to replace various ink cartridges or various inkjet printers, the use of the ink supply structure of the present invention can save cost, increase the operating efficiency and enhance the operating flexibility.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An ink supply structure, comprising:

at least one ink cartridge;

at least one dye ink chamber contained in said at least one ink cartridge for storing a dye ink;

at least one pigment ink chamber contained in said at least one ink cartridge for storing a pigment ink, a print head structure having an inkjet chip corresponding to said at least one dye ink chamber and said at least one pigment ink chamber; and at least one opening, wherein one of said dye ink within said at least one dye ink chamber and said pigment ink within said at least one pigment ink chamber is selectively supplied from said at least one ink cartridge, and said dye ink within said at least one dye ink chamber and said pigment ink within said at least one pigment ink chamber is transferred to said print head structure through said at least one opening and then ejected through said inkjet chip.

2. The ink supply structure according to claim 1, wherein said ink cartridge contains three dye ink chambers for respectively storing three monochromatic dye inks and three pigment ink chambers for respectively storing three monochromatic pigment inks, wherein said three monochromatic dye inks include a magenta dye ink, a yellow dye ink and a cyan dye ink, and said three monochromatic pigment inks include a magenta pigment ink, a yellow pigment ink and a cyan pigment ink.

3. The ink supply structure according to claim 1, wherein said ink cartridge contains six dye ink chambers for respectively storing six monochromatic dye inks and six pigment ink chambers for respectively storing six monochromatic pigment inks, wherein said six monochromatic dye inks include a magenta dye ink, a yellow dye ink, a cyan dye ink, a light magenta dye ink, a light cyan dye ink and a black dye ink, and said six monochromatic pigment inks include a magenta pigment ink, a yellow pigment ink, a cyan pigment ink, a light magenta pigment ink, a light cyan pigment ink and a black pigment ink.

4. A method of fabricating an ink supply structure, said method comprising steps:

(a) providing at least one ink cartridge, said at least one ink cartridge comprises a print head structure and at least one opening;

(b) forming at least one dye ink chamber and at least one pigment ink chamber in said at least one ink cartridge; and (c) filling a dye ink and a pigment ink into said at least one dye ink chamber and said at least one pigment ink chamber, respectively, so that said dye ink and said pigment ink are both contained in said ink cartridge and one of said dye ink within said at least one dye ink chamber and said pigment ink within said at least one pigment ink chamber is selectively supplied from said at least one ink cartridge, and said head structure having an inkjet chip corresponding to said at least one dye ink chamber and said at least one pigment ink chamber, wherein said dye ink within said at least one dye ink chamber and said pigment ink within said at least one pigment ink chamber are selected to be transferred to said print head structure through said opening and to be ejected through said inkjet chip.

* * * * *